US005454489A

United States Patent [19]

Vesborg

[11] Patent Number: 5,454,489

[45] Date of Patent: Oct. 3, 1995

[54] POURING MEMBER HAVING SELF SEALING VENTING CLOSURE

[75] Inventor: Steen Vesborg, Gentofte, Denmark

[73] Assignee: Colgate-Palmolive Company, New York, N.Y.

[21] Appl. No.: 372,707

[22] Filed: Jan. 13, 1995

Related U.S. Application Data

[63] Continuation of Ser. No. 185,091, Jan. 21, 1994, abandoned.

[51] Int. Cl.[6] ..... B65D 51/16

[52] U.S. Cl. ..... 222/109; 215/260; 215/311; 222/547; 222/562

[58] Field of Search ..... 222/108, 109, 222/111, 544, 546, 547, 562, 566, 567, 569, 570; 215/260, 270, 310, 311, 315

[56] References Cited

U.S. PATENT DOCUMENTS

| | | | |
|---|---|---|---|
| 2,829,807 | 4/1958 | Kirschenbaum | 222/546 X |
| 2,953,272 | 9/1960 | Mumford et al. | 215/260 |
| 2,975,947 | 3/1961 | Pellett | 222/546 |
| 3,067,900 | 12/1962 | Kessler | 215/260 |
| 3,189,234 | 6/1965 | Thomson | 222/562 X |
| 3,239,091 | 3/1966 | Driscoll | 215/56 |
| 3,318,496 | 5/1967 | Ayotte et al. | 222/546 |
| 3,393,818 | 7/1968 | McIntosh | 215/260 |
| 3,563,422 | 2/1971 | Crvikshank | 222/547 X |
| 3,693,847 | 9/1972 | Gibson | 222/546 |
| 3,762,612 | 10/1973 | Miller | 222/547 X |
| 3,976,216 | 8/1976 | Lambert | 215/260 X |
| 4,036,386 | 7/1977 | Nishioka et al. | 215/260 |
| 4,128,189 | 12/1978 | Baxter | 222/109 |
| 4,133,462 | 1/1979 | Lindström | 222/546 |
| 4,187,964 | 2/1980 | Bogart | 222/547 X |
| 4,206,852 | 6/1980 | Dunn et al. | 215/270 X |
| 4,387,819 | 6/1983 | Corsette | 222/569 X |
| 4,427,138 | 1/1984 | Heinlein | 222/546 |
| 4,433,800 | 2/1984 | Owens | 222/547 |
| 4,600,131 | 7/1986 | Roof et al. | 222/562 X |
| 4,765,499 | 8/1988 | von Reis et al. | 215/261 |
| 4,828,129 | 5/1989 | Jonkers | 215/260 |

FOREIGN PATENT DOCUMENTS

| | | | |
|---|---|---|---|
| 0248744 | 12/1987 | European Pat. Off. | 215/260 |
| 3905017 | 8/1990 | Germany | 215/260 |
| 969322 | 9/1964 | United Kingdom | 215/260 |
| 1004364 | 9/1965 | United Kingdom | 215/260 |
| 2013635 | 8/1979 | United Kingdom | 215/260 |

*Primary Examiner*—Kevin P. Shaver
*Attorney, Agent, or Firm*—Michael J. McGreal; Robert C. Sullivan

[57] ABSTRACT

A self-sealing closure device for a container comprising an insert (1) adapted to be secured within a container neck (2) and comprising a pouring opening as well as a cap (11) adapted to be fastened on the container neck (2). The insert (1) comprises an inwardly extending resilient conically shaped sealing device (8), which at its inner end is provided with an upwardly facing sealing face (10) adapted to sealingly co-operate with a downwardly facing sealing face (18) on the cap (11). The sealing engagement of the two sealing faces (10, 18) being released at a predetermined internal overpressure in the container.

11 Claims, 2 Drawing Sheets

POURING MEMBER HAVING SELF SEALING VENTING CLOSURE

This is a continuation, of application Ser. No. 08/185,091 filed Jan. 21, 1994 now abandoned.

The invention relates to a closure device for closing an opening in a neck of a container containing a product releasing gases for a controlled venting of said container and comprising:

a pouring member provided with a pouring opening and an outer wall adapted to be sealingly fastened to the neck of the container, a cap comprising an upper wall and a side wall provided with a fastening means adapted to co-operate with a fastening means on the container or the pouring member so as to fasten the cap thereto, and a self-sealing venting means operating between the cap and the pouring member and closing the container and ensuring a venting of said container where the pressure difference between the interior of said container and the surroundings exceeds a specific value.

BACKGROUND ART

Some products, especially fluids, are sold in containers in which they slowly release gases resulting in an overpressure in the interior of the container. This applies for instance to some bleaching products containing hydrogen peroxide, chlorine or chlorine doners percarbonate or perborate. In order to prevent such gas-releasing products from causing an inappropriately high internal overpressure in the container containing said products, said container is often provided with a so-called venting cap, i.e. a self-sealing cap ensuring a venting of the container when the internal overpressure exceeds a predetermined amount.

A wide range of various venting caps are known. U.S. Pat. No. 3,067,900 discloses a plastic screw cap comprising a thin resilient frusto-conical sealing member, which extends downwards and outwards from the bottom side of the upper wall of the cap so as to resiliently and sealingly engage the pouring lip of the neck of the container to be closed.

Furthermore, EP-B1-0 267 748 discloses a screw cap provided with an upper flange extending inwards from the skirt and connected through a number of resilient spokes to a disc-shaped, centrally arranged sealing means; When the cap is screwed down, the sealing means sealingly abut the edge of the neck of the container to be closed. When the internal overpressure increases sufficiently, the sealing means is forced upwards and out of engagement with the container with the result that said container is vented. Subsequently, the sealing means returns to the sealing position.

Several of the known venting caps are encumbered with the draw-back that they do not provide a specific venting pressure, and/or that they are not able to completely seal the container after the first venting. Such problems apply in particular to foaming, tacky and/or viscous fluids.

SUMMARY OF THE INVENTION

In view of the above, the object of the present invention is to provide a closure device of the above type which is of a simple structure and opens reliably at a well-defined opening pressure and seals reliably at a lower pressure.

In satisfaction of the foregoing object the closure device according to the invention is characterised in that the venting means comprises a resilient means of the pouring member and arranged between the outer wall of said pouring member and a circumferential sealing means thereof with an upwardly facing sealing face biased to sealingly engage a downwardly facing sealing face on a lower face of the cap. Considering the forces exerted by an internal overpressure in the container on the resilient means and the sealing means thereof, one would believe that an increasing internal overpressure would provide an increasing sealing effect between the sealing face on the sealing means of the pouring member and the sealing face on the cap. However, it turned out surprisingly that the closure device according to the invention renders it possible to obtain a very well-defined and reproducible opening pressure as well as a wry reliable sealing at internal overpressures lower than the predetermined opening pressure. Without knowing for sure a possible explanation may be found in the microscopical conditions in the sealing gap between the two sealing faces, as said sealing gap may include small areas with a lower sealing effect than the majority of said sealing gap, and as a leak and consequently a venting is initiated in these small areas with the effect that an internal pressure in the sealing gap causes an opening of the entire sealing gap.

According to the invention one of the two sealing faces, preferably the sealing face on the cap, may be convexly curved. In this manner the penetration of the gas into the sealing gap should be facilitated and thereby open said gap for a controlled release of gas a predetermined internal overpressure.

In addition according to the invention, the resilient means may be a substantially frusto-conically shaped disk-like means with a diameter decreasing outwardly towards the upper wall of the cap. In this manner the resilient means is formed as a disk spring resiliently pressing the sealing means into sealing abutment against the sealing face on the cap.

Furthermore the sealing means may according to the invention be a substantially rigid, annular body.

Moreover according to the invention the sealing means may in particular be shaped as a substantially rigid, cylindrical body of a substantial axial extent.

Furthermore an annular wall may in connection with the above embodiment extend inwardly and downwardly from the cylindrical sealing means and continue into a substantially axially outwardly extending spout with a side opening at a lowest positioned portion of the annular wall. In practise this embodiment of the invention turned out to provide very fine results concerning the reproducibility of the opening pressure and the sealing of the container. Furthermore it turned out to be particularly simple to set the opening pressure to the desired value by adjusting the rigidity of the resilient, disk-like means, either by changing the thickness thereof or by manufacturing said means, i.e. The entire pouring member, of a plastic material with the desired modulus of elasticity.

In addition according to the invention the pouring member may be shaped as an insert, the outer wall thereof being adapted to be sealingly fastened within the neck opening of the container.

In particular in connection with the above embodiment of the invention it turned out to be advantageous that the pouring member and the cap comprise co-operating engaging means to exactly define the axial position of the pouring member and the cap in relation to one another and consequently to exactly define the bias of the resilient means, and that the engaging means provides a retaining force being weaker than the retaining force between the pouring member and the container neck. In this manner the pouring member can be arranged in the plug before the two members are mounted as a unit on the container neck. As a result, the mutual position of the two members has been exactly defined in advance, whereby the position of the pouring member relative to the container neck has no influence on the bias of the resilient disk-like means. Another aidvantage is found in the fact that only one member need be mounted on the filling line, viz. the assembly of the pouring member and the cap instead of two separate members.

In connection with the above embodiment of the invention, the co-operating- engaging means may moreover according to the invention preferably comprise snapping means in form of a co-operating circumferential radial ridge and groove. This embodiment of the invention turned out in practise to provide good results.

Moreover according to the invention the fastening means on the plug and the container or the pouring member may be a thread. This fastening means will probably be preferred in practise.

Finally according to the invention the cap may be a screw cap, and an outer cap may be arranged on said screw cap with an axial play therebetween, and the two caps may be provided with co-operating projections and grooves, which can be caused to engage one another within the axial play, the faces of the projections and the grooves engaging one another when the cap is screwed down being shaped as carriers, whereas the faces of the projections and the grooves engaging one another when said cap is screwed off are shaped as cam faces co-operating so as to lift the projections and grooves of the outer cap out of engagement with the projection and grooves of the screw cap in the axial upward direction, whereby the outer cap carries the screw cap in connection with a screwing down and in connection with a screwing off is lifted upwards and out of engagement with said screw cap unless it is subjected to an axial pressure. The resulting embodiment of the invention provides a so-called child-proof closure device preventing small children from opening the container. The latter is advantageous and often a requirement to a wide range of household chemicals in containers with a screw cap.

BRIEF DESCRIPTION OF THE DRAWING

The invention is explained in greater detail below with reference to the accompanying drawing, in which.

DESCRIPTION OF THE PREFERRED EMBODIMENT

Figure 1:
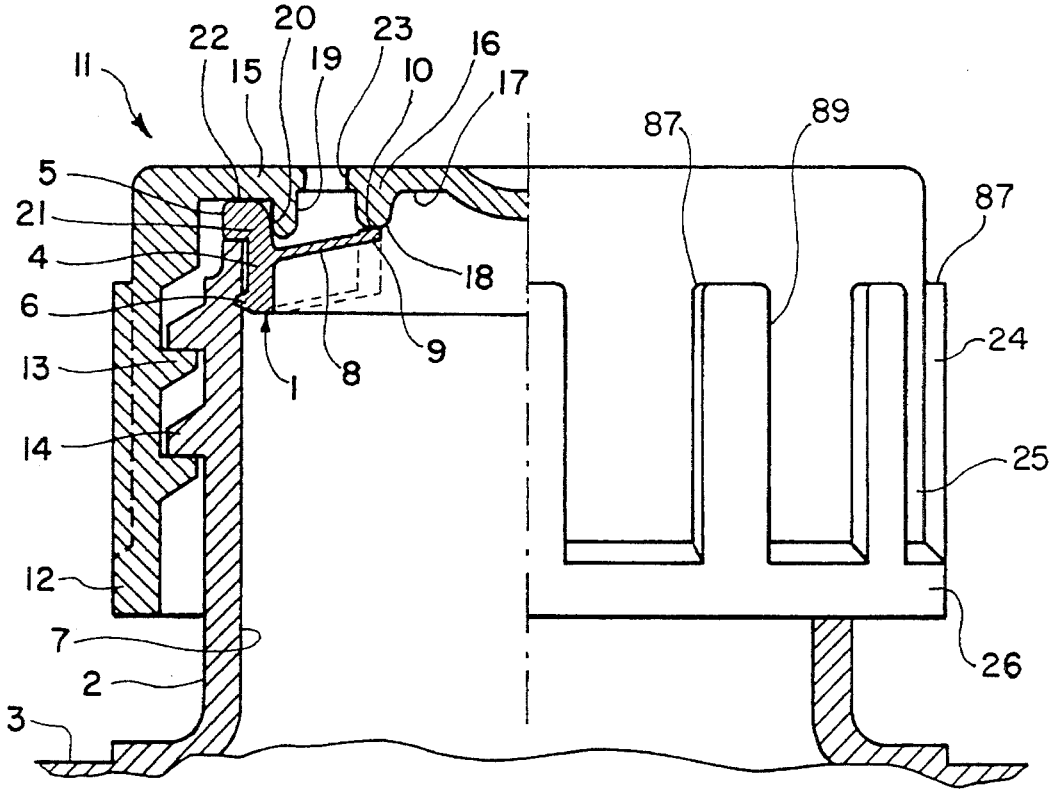
FIG. 1 is partially a vertical, sectional view and partially a side view of a first embodiment of a closure device according to the invention.

The embodiment of FIG. 1 of the closure device according to the invention comprises a pouring member 1 arranged in the opening of the neck 2 of a container 3, only a portion of said container being shown. The pouring member 1 comprises an outer wall 4 and at the upper end thereof an outward flange 5. At the lower end of the outer wall 4 an annular ridge 6 is provided which sealingly engage the internal face 7 of the neck 2 in a locking manner. A resilient, disk-like means 8 is formed as a conical disk and extends inwards from the outer wall 4, said disk 8 being of a decreasing diameter in the axially outward direction. At its inner end the disk is provided with a sealing means 9 shaped as a low cylinder. The upper face 10 of the cylinder 9 forms a sealing face.

The pouring member 1 is preferably injection molded in one piece of a plastic material, such as polyethylene.

As indicated by means of dotted lines, the resilient conical disk may also extend from the lower end of the outer wall, and the cylindrical sealing means may thereby be of a higher height. As a result, a more uniform distribution of the pressure in the sealing gap is obtained circumferentially of the sealing faces.

The closure device comprises furthermore a cap 11 with a skirt 12, which is provided with a fastening means 13 in form of an internal thread engaging an external thread 14 on the neck of the container 3. The cap comprises an upper wall 15 at the upper end of the skirt 12. An annular rib 16 extends downwards from the inner face 17 of the upper wall 15. At the inner end the annular rib 16 comprises a sealing face 18 of a slightly curved cross-sectional shape, which is adapted to co-operate with the sealing face on the cylindrical sealing means 9 of the pouring member 1. Radially outwardly of the annular rib 16, a further annular rib 19 extends downwards from the lower face of the upper wall 15. The outer rib 19 comprises an outward, circumferential ridge 20 adapted to engage an annular groove 21 in the inner face of the outer wall 4 of the pouring member 1. When the ridge 20 engages the groove 21, the upper face 22 of the flange 5 of the pouring member 1 abuts the inner face of the upper wall 15 of the cap 11. The engagement of the ridge 20 in the groove 21 provides an easily disengage able connection between the pouring member 1 and the cap 11. At the same time, the abutment between the upper face 22 of the flange 5 and the inner face of the upper wall 15 ensures an exact positioning of the pouring member 1 relative to the cap 11 in connection with said engagement and consequently an exactly defined deformation in axial direction of the resilient disk 8 acting as a disk spring and consequently of the bias of said disk. Finally, an opening 23 is provided in the upper wall of the cap 11 in the portion between the two annular ribs 16 and 19.

A plurality of axially extending projections 24 and grooves 25 are provided on the outer face of the skirt 12 of the cap 11, said projections and grooves extending a distance upwards from a lower annular bead 26. The upper face of the annular bead 26 flushes with the upper face of the projections 24.

The cap is preferably injection molded of a plastic material, such as polypropylene.

At a predetermined overpressure inside the container, gas can flow through the sealing gap between the sealing face 10 of the pouring member 1 and the sealing face 18 of the cap and further out to the surroundings through the opening 23 in the upper wall of the cap. The internal overpressure necessary for opening said sealing gap depends on the sealing force in said sealing gap and consequently of the force exerted by the conical disk 8. This force is determined by the deformation of the disk 8, the thickness of the disk as well as of the material of the disk and consequently of the pouring member 1. In practise it turned out to be possible to set the opening pressure very accurately, and an opening pressure of the magnitude 0,1 to 0,5 atm., preferably substantially 0,3 atm. is considered advantageous for most purposes.

Figure 2:
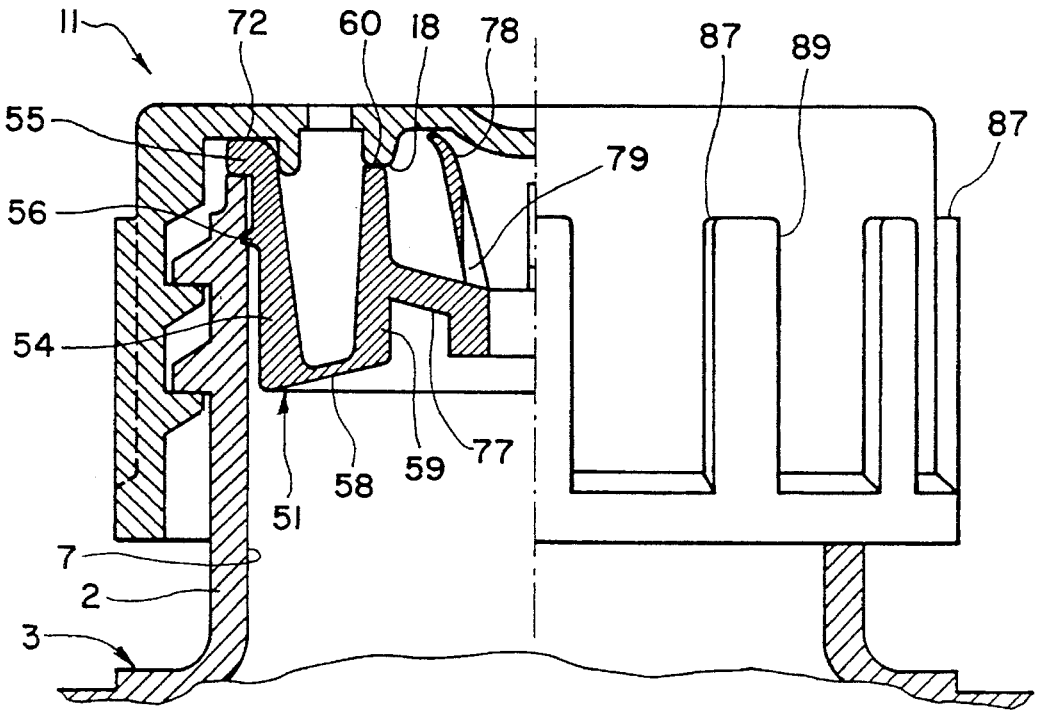
FIG. 2 is partially a vertical, sectional view and partially a side view of a second embodiment of a closure device according to the invention.

The second embodiment of the closure device according to the invention shown in FIG. 2 comprises also a pouring member 51 and a cap 11. The sap 11 is identical with the cap described in connection with FIG. 1, and it is therefore not described in greater detail.

The pouring member 51 corresponds in many respects to the pouring member 1 described with reference to FIG. 1. Thus the pouring member 51 comprises an outer wall 54 provided with an annular outward ridge 56, which sealingly engages the inner face 7 of the container neck 2. At the upper end, the outer wall 54 comprises a flange 55, the upper face of which abuts the inner face of the upper wall 15 of the cap. At the lower end, the outer wall 4 comprises a resilient conical disk member 58, which in turn comprises a cylindrical sealing means 59 of a substantial height at its inner end. The upper face of the cylindrical body 59 forms a sealing face 60 adapted to sealingly co-operate with the sealing face 18 on the cap 11. An annular wall 77 extends inwards and downwards from the cylindrical sealing means 59 and continues into a substantially axially outwardly extending spout 78. The spout is provided with three equally spaced openings 79 in the area of said spout adjacent the lowest area of the annular wall 77, only two of said openings appearing from FIG. 2. The purpose of these openings is to allow the drops running down the outer side of the spout to return to the interior of the container after a pouring of the contents of said container.

Figure 3:
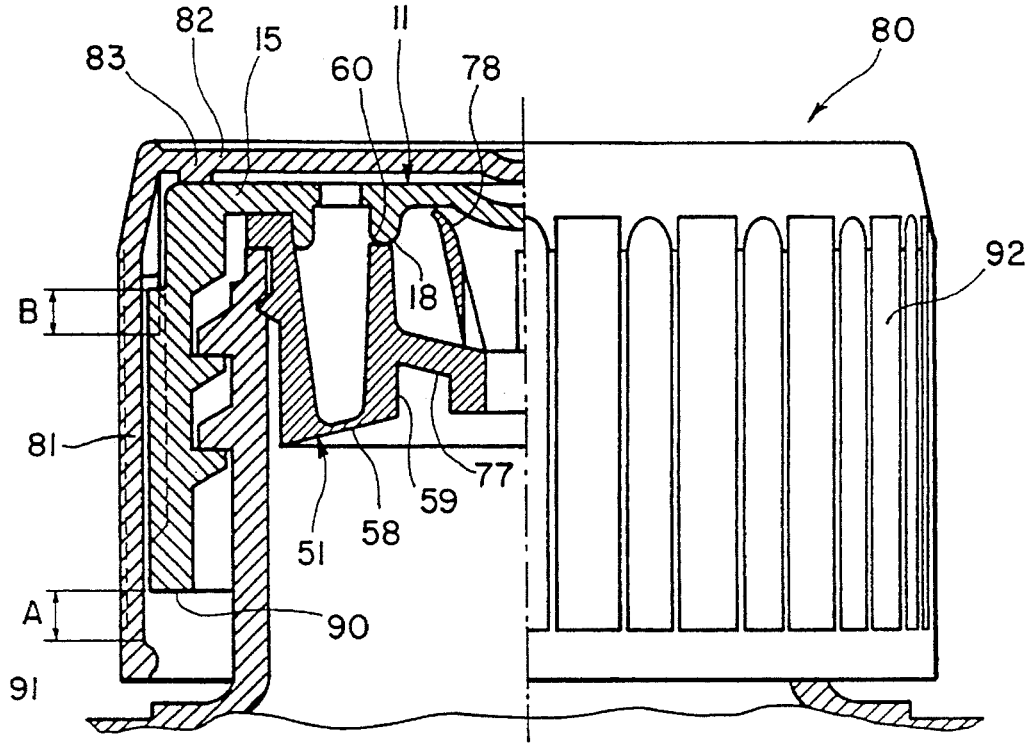
FIG. 3 is partially a vertical, sectional view and partially a side view of a third embodiment of a closure device according to the invention shaped as a child-proof closure device.
Figure 4:
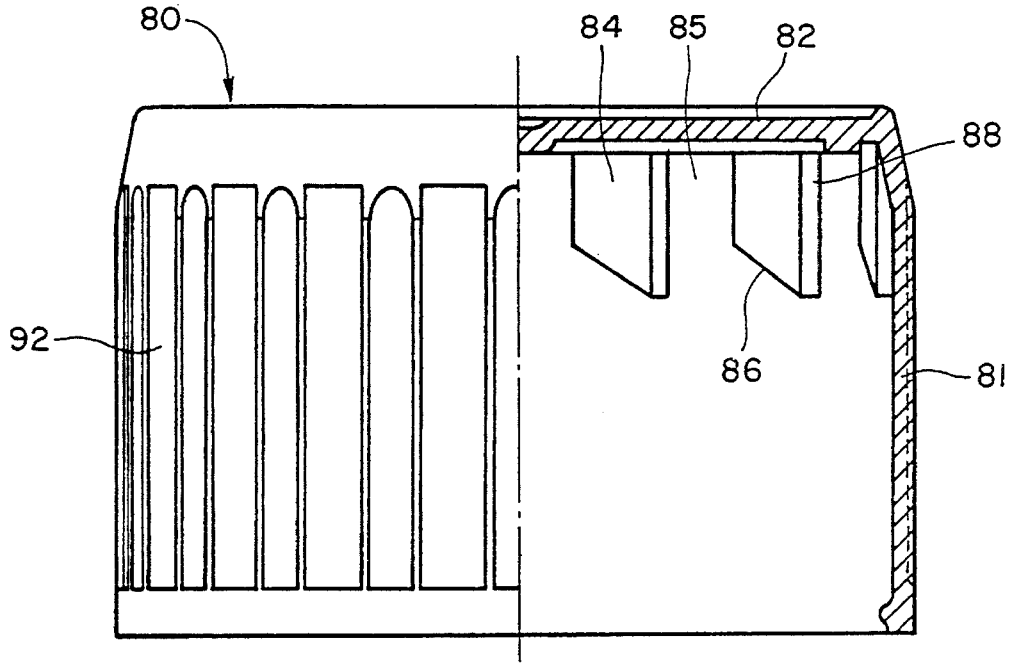
FIG. 4 is partially a side view and partially a vertical sectional view of an outer cap of the embodiment of FIG. 3 of the invention.

The further embodiment of the invention shown in FIGS. 3 and 4 corresponds to the embodiment of FIG. 2 with the modification that an outer cap 88 is arranged on the screw cap 11 with an axial play A.

The outer cap 80 comprises a circumferential skirt 81 and an upper wall 82 at the upper end of said skirt. An annular rib 83 extends downwards from the inner face of the upper wall 82 and is adapted to abut the upper face of the upper wall 15 of the screw cap 11. A plurality of projections 84 and grooves 85 are provided on the inner face of the skirt 81 in the portion adjacent the upper wall. These projections 84 and grooves 85 are arranged such that they may engage the grooves 25 and the projections 24 on the screw cap 11. Downwardly, the projections 84 end in an inclined side face 86 inclining downwards and rearwards when seen in the screwing off direction of the cap. Thus the inclined side faces 86 form cam faces for lifting the outer cap 80 axially upwards when they abut the upper front corner 87 of the projections 24 on the screw cap 10 when seen in the screwing off direction at attempts at screwing off said cap unless an predetermined axial pressure is exerted on the outer cap 80 in the downward direction. When the cap is screwed down, the front side faces 88 in the screwing down direction of the projections 84 of the outer cap 80 abut the front side faces 89 of the projections 24 of the screw cap 11, whereby said screw cap 11 is carried by the outer cap 80 when said outer cap 80 is subjected to a screwing.

The axial lifting of the outer cap during the screwing down is allowed by said play A which is defined by the distance between the lower edge 90 on the screw cap 11 and an inwardly extending annular bead 91 on the inner face of the skirt 81 of the outer cap 80. The play A exceeds, of course, the axial engagement B between the projections 84 and the grooves 85 on the outer cap 80 and the projections 25 and the grooves 24 on the screw cap 11.

The outer cap 80 is preferably injection molded of a plastic material, such as polypropylene or polyethylene. The outer face thereof is provided with axially extending profilings 92 so as to ensure a good grip.

I claim:

1. A closure device for closing an opening in a neck of a container (3) containing a product releasing gases for a controlled venting of said container, said closure device comprising a pouring member provided with a pouring opening and comprising an outer Wall adapted to be sealingly fastened to the neck of the container, a cap with an upper wall and a side wall provided with a fastening means adapted to co-operate with a fastening means on the container or the pouring member for a fastening of the cap thereto, and a self-sealing venting means operating between the cap and the pouring member and closing the container and ensuring a venting of said container when the pressure difference between the interior of said container and the surroundings exceeds a specific value, wherein the venting means comprises a resilient means provided on the pouring member and arranged between the outer wall of the pouring member and a circumferential sealing means thereof with an upwardly facing sealing face biased for a sealing engagement with a downwardly facing sealing face on the cap.

2. A closure device as in claim 1, wherein the two sealing faces are convexly curved.

3. A closure device as in claim 1, wherein the resilient means is a substantially frusto-conically shaped disk-like means with a diameter decreasing in the outward direction towards the upper wall of the cap.

4. A closure device as in claim 1, wherein the sealing means is a substantially rigid, annular body.

5. A closure device as in claim 1, wherein the sealing means is shaped as a substantially rigid, cylindrical body with a substantial, axial extent.

6. A closure device as in claim 5, wherein an annular wall extends inwards and downwards from the cylindrical sealing means and continues into a substantially axially outwardly extending spout with a side opening at the lowest portion of the annular wall.

7. A closure device as in claim 1, wherein the pouring member is shaped as an insert, the outer wall thereof being adapted to be sealingly secured within the neck of the container.

8. A closure device as in claim 1, wherein the pouring member and the cap comprise co-operating engaging means to exactly define the axial position of said pouring member and the cap in relation to one another and consequently to exactly define the bias of the resilient means and that the engaging means provide a retaining force being weaker than the retaining force between the pouring member and the container neck.

9. A closure device as in claim 8, wherein the co-operating engaging means comprise snapping means in form of a co-operating, circumferential, radial ridge and groove.

10. A closure device as in claim 1, wherein the fastening means on the cap and the container or the pouring member is a thread.

11. A closure device as in claim 1, wherein the cap is a screw cap, and that an outer cap is arranged on said screw cap with an axial play therebetween, and that the two caps are provided with co-operating projections and grooves, which can be caused to engage one another within the axial play, the faces of the projections and the grooves engaging one another when the cap is screwed down being shaped as carriers, whereas the faces of the projections and the grooves engaging one another when said cap is screwed off are shaped as co-operating cam faces so as to lift the projections and the grooves of the outer cap out of the engagement with the projections and the grooves of the screw cap in axial upward direction, whereby said outer cap carries the screw cap in connection with a screwing down, but in connection with a screwing of is lifted upwards and out of the carrying engagement with the screw cap unless it is subjected to a predetermined axial pressure.

* * * * *